United States Patent [19]

Epperson et al.

[11] 3,939,063

[45] Feb. 17, 1976

[54] LOOSE FLAP DETECTOR AND CASE EJECTOR SYSTEM FOR WRAP-AROUND PAPERBOARD CARTONS

[75] Inventors: Otis A. Epperson, Greenwood; Raymond H. Smith, Ft. Smith, both of Ark.

[73] Assignee: Gerber Products Company, Fremont, Mich.

[22] Filed: Oct. 10, 1974

[21] Appl. No.: 513,673

[52] U.S. Cl. ..... 209/7; 209/111.7 T

[51] Int. Cl.[2] ..... B03B 1/00

[58] Field of Search ..... 209/111.7, 73, 74, 82, 209/90, 88, 3, 4, 7, 79; 53/53; 73/52, 12

[56] References Cited

UNITED STATES PATENTS

| | | | |
|---|---|---|---|
| 2,699,672 | 1/1955 | Couch et al. | 73/12 |
| 2,922,519 | 1/1960 | Radley | 209/111.7 |
| 3,117,441 | 1/1964 | Zimmerman | 73/52 X |
| 3,606,014 | 9/1971 | Linn | 209/79 |
| 3,703,235 | 11/1972 | McEnery | 209/79 |
| 3,825,750 | 7/1974 | Hayase et al. | 209/111.7 |

*Primary Examiner*—Allen N. Knowles

*Attorney, Agent, or Firm*—Townsend and Townsend

[57] ABSTRACT

Method and apparatus for detecting insecurely glued closure flaps on wrap-around paperboard cartons and for diverting defectively sealed cartons from the packaging line. A striking device in the form of an impact roller strikes the leading edge of each carton as it moves along a conveyor belt. Loose or insecure flaps opened by the impact are detected as the carton passes through a photocell station. Upon identification of an open flap condition a pivotal eject chute forming a part of the conveyor table is actuated downwardly to divert the rejected carton to a remote location for inspection and resealing or replacement.

3 Claims, 13 Drawing Figures

12
14
14a
14b
14c
14d
16
16a
16b
16c
16d
18
18a
18b
20
22
24
30
40
42
50
X
Y

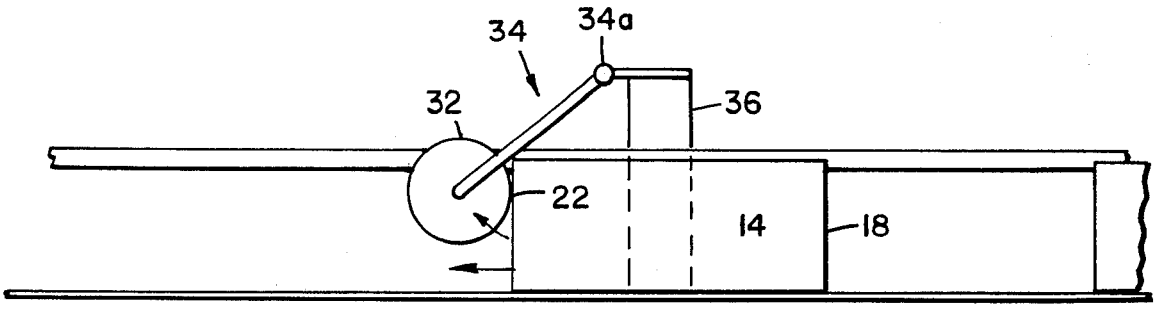
FIG_4A
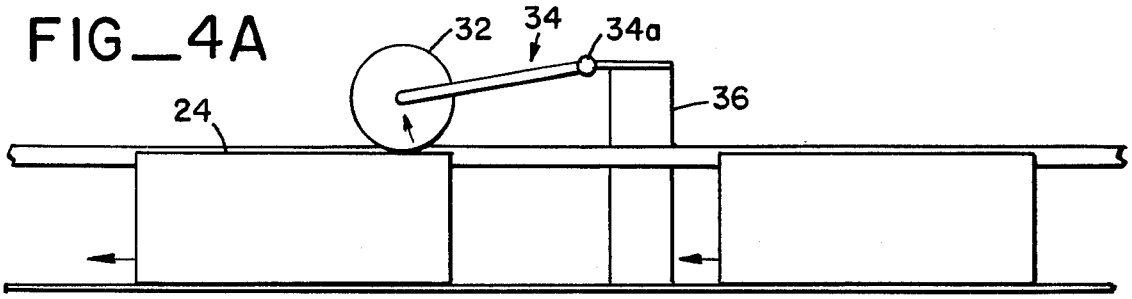
FIG_4B
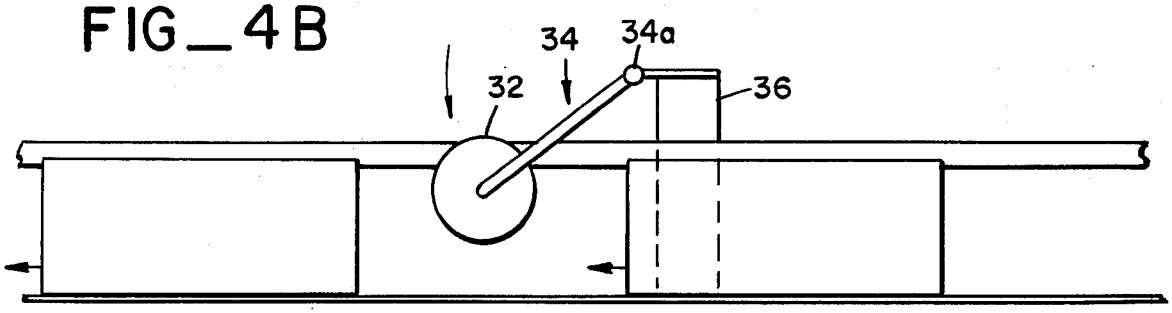
FIG_4C
FIG_7
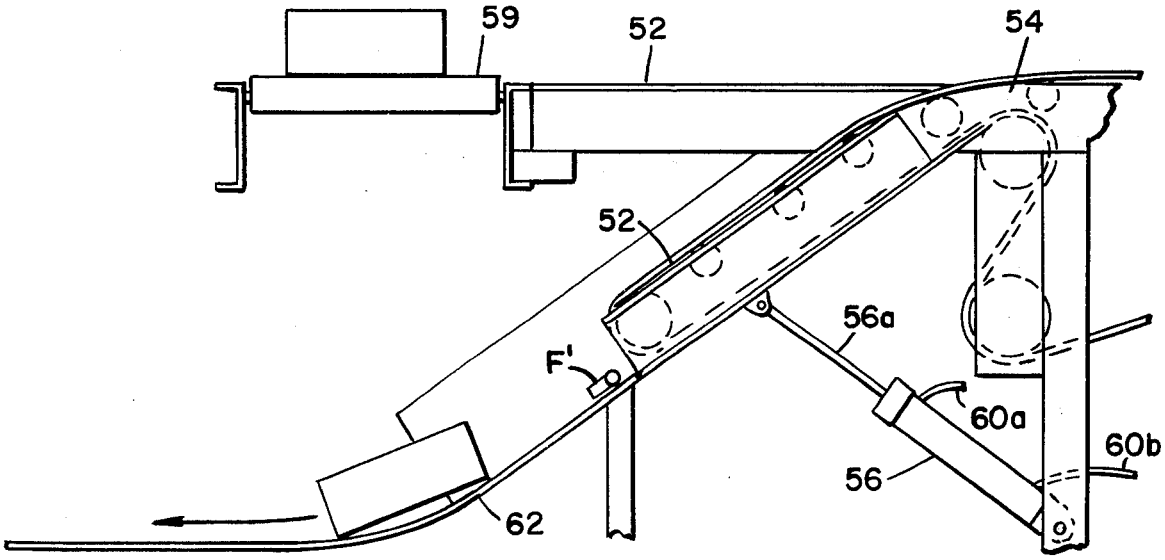

LOOSE FLAP DETECTOR AND CASE EJECTOR SYSTEM FOR WRAP-AROUND PAPERBOARD CARTONS

The present invention relates to carton handling apparatus and is more particularly directed to a system and method for detection of loose or partially unglued closure flaps on containers of the wrap-around carton type and for diverting improperly sealed cases from the packaging line onto an auxiliary line for repair or replacement.

A recent innovation in the packaging of filled glass jars, such as used in the baby food industry, has become known as the "wrap-around" carton. According to this packaging construction, the bulky cardboard partitions previously inserted between adjacent jars to prevent breakage on impact have been eliminated. This has been achieved by arranging the jars in nested engagement in staggered rows instead of the conventional "on-diameter" configuration, and by forming a warp-around carton tightly around the jars in such a manner that they are maintained in constant physical contact with each other. Under such conditions it is difficult, if not impossible, for the individual glass jars to impact with adjacent jars with sufficient force to cause glass breakage. Such a container and method of packaging is more fully disclosed in co-pending U.S. Pat. application Ser. No. 153,854, filed June 16, 1971, now abandoned, entitled "Wrap-Around Partitionless packaging" and assigned to common assignee.

A problem which has been encountered in connection with such wrap-around packaging is that the unitary integrity of the carton and contents which is necessary to ensure constant physical contact between the jars and thus avoid breakage depends on the maintenance of all flap seals. As a result, if any flap is improperly glued or only partially glued the desired resistance to impact forces will be lost.

Accordingly, it is a primary object of the present invention to provide a system whereby such improperly glued closure flaps may be easily detected and diverted from the packaging line without causing any noticeable interruption in the carton flow rate. It is a further object to provide such a system which is simple in construction and is easily adaptable to cartons of different shapes and sizes. A still further object is to provide such a system wherein operator intervention is seldom, if ever, required.

These and other object features and advantages of the present invention will become more readily apparent after reading the following detailed description with reference to the accompanying drawings wherein:

FIGS. 4A–4C are a series of schematic side-elevation views showing in time sequence the impact roller striker mechanism which opens any partially glued flaps for detection;

FIG. 7 is a schematic side elevation view of the case eject mechanism of the present invention.

Figures 1, 2, 3:
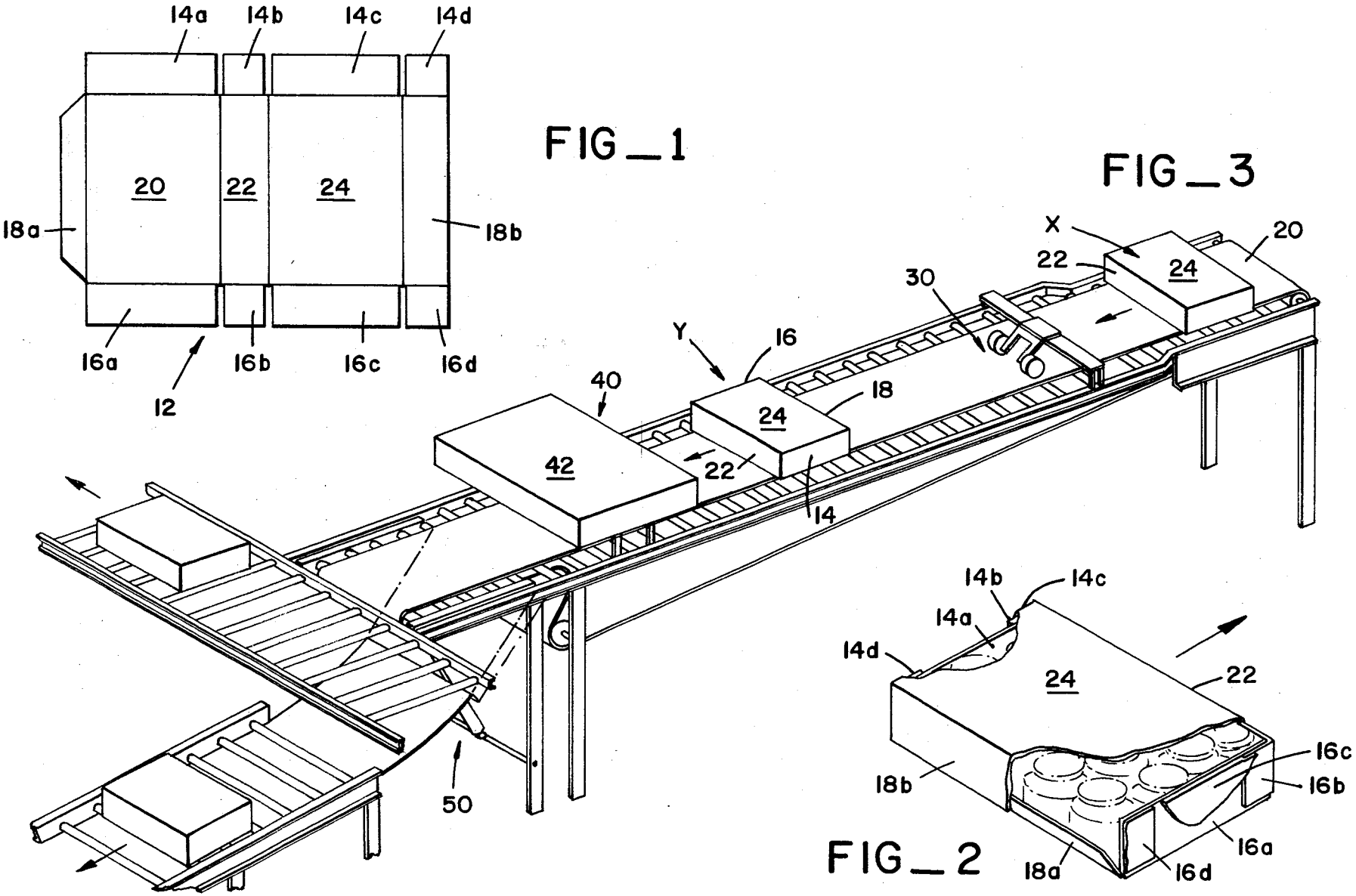
FIG. 1 is a plan view of a warp-around carton blank in a flat, unfolded condition.
FIG. 2 is a partially cut-away perspective view depicting the arrangement of the jars within a fully formed and sealed carton, and further illustrating the position of the various closure flaps.
FIG. 3 is an overall perspective view of a loose flap detector and case eject work station according to the present invention.

Referring now to the drawings wherein like numerals in the different views represent the same element, FIG. 1 illustrates an unformed, flat carton blank 12 of the wrap-around partitionless type, such as disclosed in the co-pending patent application referred to above. As contrasted with conventional top-opening cartons, the wrap-around container includes eight side closure flaps which together form the two side walls of the carton and two end closure flaps which cooperate to form one end wall of the carton when formed.

More specifically, side flaps 14*a* –14*d* when folded and glued form container side wall 14 (see FIG. 3). Similarly, side flaps 16*a*–16*d* form side wall 16 (FIG. 3) when the carton is formed. End tab 18*a* and end flap 18*b* together form the conventional manufacturer's joint or seal and comprise the trailing end wall 18 of the carton as it moves through the work station depicted in FIG. 3. Finally, bottom panel 20, end panel 22, and top panel 24 respectively form the bottom, leading end wall and top surfaces of the container as it moves down the conveyor line.

The positioning of the various side and end flaps discussed in connection with FIG. 1 in their fully folded and sealed condition is illustrated in FIG. 2.

FIG. 3 is an overall perspective view illustrating the various components of a loose flap detector and case eject work station according to the present invention. In addition to a conventional powered roller conveyor belt 20 and support structure, the essential components of the present invention comprise striker mechanism 30 more fully described below in connection with FIG. 4, photocell detector station 40 more fully described below in connection with FIGS. 5 and 6, and case eject chute mechanism 50 more fully described below in connection with FIG. 7. The circuitry that coordinates the operation of the photocell detector system 40 and the case ejector chute mechanism 50 is more fully described below in connection with FIG. 8.

Referring now to FIG. 3 the overall operation of the loose flap detector and case eject system is as follows. As the carton moves down the conveyor belt at a speed of about 90 feet per minute from position X to position Y, leading end wall 22 is struck near its upper edge by the impact roller of striker assembly 30. Upon impact, the constant physical contact of the jars inside the carton tends to cause a shifting of the containers which, in response to the internal forces generated due to the tight packing of the jars, causes any insecurely glued flaps to spring open. As the carton moves through the photocell detector station 40 any loose flaps which have been opened by the impact roller mechanism will be detected. Such detection will in turn cause actuation of the table drop mechanism of eject chute 50 which will divert the rejected carton to a location where it may be properly resealed or replaced.

FIGS. 4A–4C illustrate in time sequence the operation of the impact roller striker mechanism which opens any improperly glued flaps. Double-element roller 32 is pivotally suspended from support rail 36 which bridges the conveyor belt by drop hinge 34, which allows the roller to move in an arc about the hinge pivot point 34*a*. With no interference from a carton, roller 32 under its own weight will pivot downwardly into a position below the level of the carton top surfaces 24 as shown in FIG. 4A.

As a carton moves down the line from position X to position Y (FIG. 3) the upper portion of leading edge 22 will collide with roller 32 with sufficient impact so that the internal forces created within the carton will cause any unglued flaps to spring open. As the carton continues along, the conveyor hinge mounting 34 allows roller 32 to pivot upwardly and ride along the upper surface 24 of the carton as shown in FIG. 4B. As roller 32 passes over the rear portion of carton top surface 24 its own weight will cause it to descend to the position shown in FIG. 4C until it is contacted by the next carton in the line.

Figure 5:
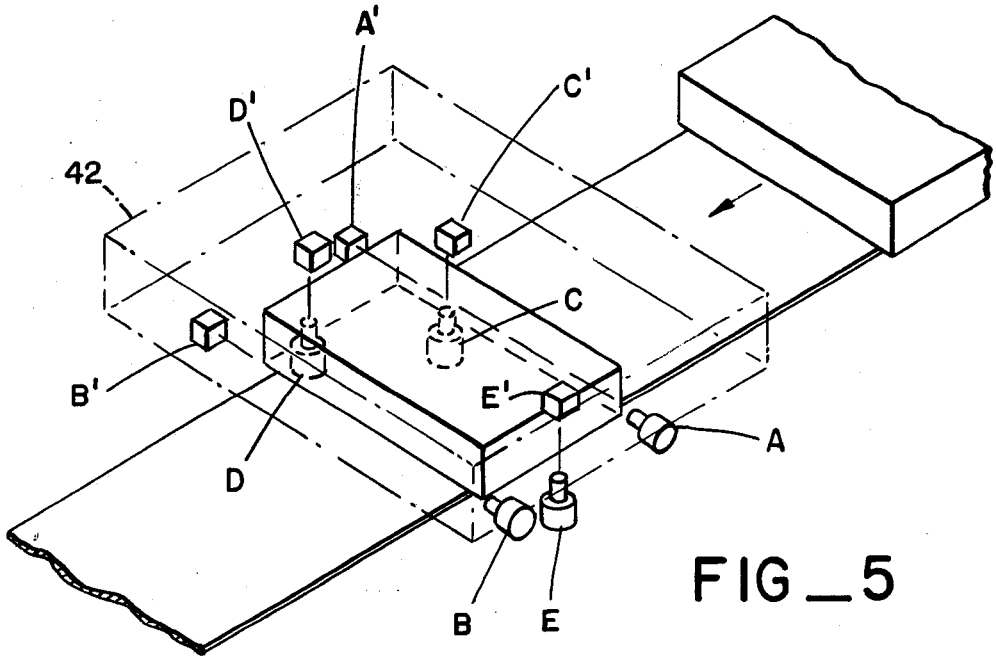
FIG. 5 is a pictorial perspective view of the photocell open flap detector unit which determines whether any flaps have been opened by the impact roller of FIGS. 4.

FIG. 5 and FIGS. 6 together illustrate the photocell arrangement by which various open flap or deformed carton conditions are detected. Light source A directs a beam of light across the belt toward photocell A′ in a direction substantially transverse to the path of motion of the carton and at a vertical level of about the carton mid-line. Similarly, light source B directs a beam of light across the path of carton movement toward photocell B′. Photocell and light source pairs A, A′ and B, B′ together determine the width of a carton as follows. Light path B—B′ (from light source B to photocell B′) serves as the reference or index position against which certain other photocell conditions are compared. Thus, the instant light path B—B′ is broken, other photocells are "interrogated" to determine whether any reject conditions exist. The individual light source units and photocells are movably mounted on support rails so that the spacing between light path B—B′ and light path A—A′ is adjustable. For a given carton size this dimension is preset so as to exceed by a slight amount the maximum allowable carton width. Thus, if light path B—B′ and light path A—A′ are at any instant simultaneously interrupted a condition is indicated which represents a carton that is wider than the preselected maximum dimension or one that is not square. This can occur, for example, when the impact force from roller 32 causes the internal forces to bulge out the manufacturer's joint as shown in FIG. 6C.

Light source C and photocell C′ cooperate to respectively generate and detect a light beam C—C′ in a vertical direction at a point just behind the trailing edge of the carton when the leading edge first interrupts light path B—B′. Thus, simultaneous interruption of light paths B—B′ and C—C′ will indicate that the manufacturer's joint has ruptured, opening end flap 18*b*. Photocell C′ is mounted in cover 42 which is mounted above conveyor belt 20 and which also houses the various electrical circuitry (including relays, indicator lights, etc.) which will be discussed below in connection with FIG. 8.

Finally, light source and photocell combinations D, D′ and E, E′ are positioned on opposite sides of the carton just outside side edges 16 and 14 respectively. Light beams D—D′ and E′E′ are directed vertically upward so that beam D—D′ will be interrupted by the opening of side flap 14*c* (and side flap 14*a*) while beam E—E′ will be interrupted by the opening of side flap 16*c* (and side flap 16*a*). Photocells D′ and E′ are mounted in cover 42.

Figure 6A:
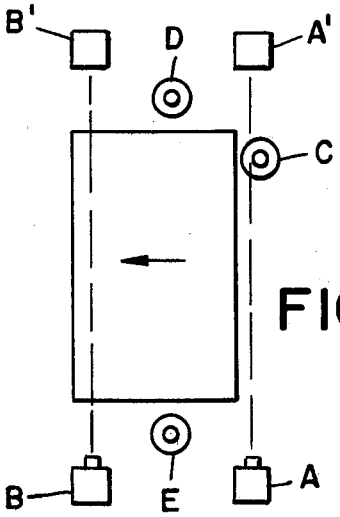
FIGS. 6A–6D are a series of schematic plan views of the positions of the various open flap-detector photocells, illustrating a normal carton and cartons in various reject conditions.
Figure 6B:
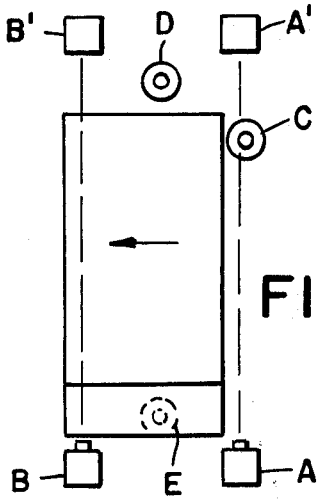
Figure 6C:
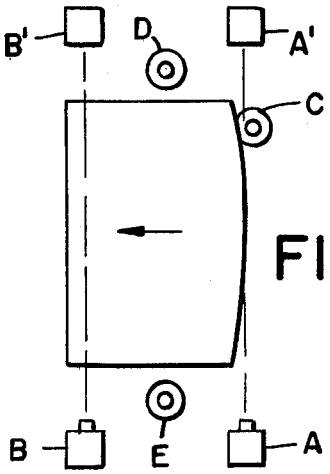
Figure 6D:
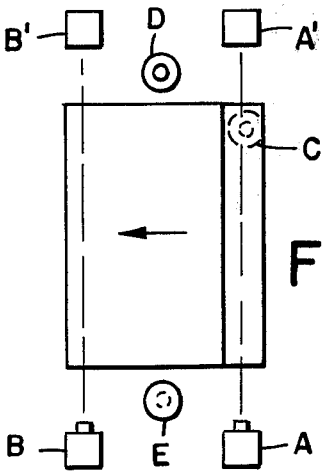

The various carton conditions illustrated in FIGS. 6A–6D are as follows: FIG. 6D, normal carton; FIG. 6B, side flap (14*c*) open; FIG. 6C, deformed carton indicating faulty manufacturer's seal; FIG. 6D, end flap (18*b*) open.

FIG. 7 illustrates the drop chute mechanism of case eject station 50 in greater detail. The upper portion of the eject chute is formed by the final section 52 of conveyor belt 20 immediately downstream of photocell detector station 40. Belt section 52 is pivotally mounted at point 54 to the conveyor table frame so as to permit downward motion in an arc about pivot point 54. The end positions of this pivotal motion correspond to "table down" and "table up" conditions. The motion of belt section 52 is controlled by dual-action pneumatic cylinder 56 which is controlled by a double solenoid air control valve 58 (not shown) via air hoses 60*a* and 60*b*. When the air pressure in upper air hose 60*a* is increased in response to the proper solenoid control signal, piston rod 56*a* is retracted into cylinder 56 pivoting belt section 52 down into its "table down" position. Similarly, when the relative air pressure in lower hose 60*b* is increased the piston rod is forced out of the cylinder pivoting belt section 52 to its "table up" position.

As will be discussed below in connection with FIG. 8, when the photocell detector logic circuitry determines that one or more loose flap conditions exist in a box passing through the photocell station a control signal is supplied to the "table down" solenoid valve 58 causing belt section 52 to move to its "table down" position and diverting the rejected carton from the packaging line to a location where it may be inspected and either properly resealed or discarded and the jars repacked.

Photocell F′ is positioned in alignment with a corresponding light source F (not shown) which directs a light beam F—F′ across the path of a carton moving down stationary eject chute 62 which immediately follows belt section 52 in its "table-down" configuration. Interruption of light beam F—F′ causes actuation of the "table-up" solenoid (after a suitable delay) to restore belt section 52 to its horizontal non-reject position. Additionally each interruption of light beam F—F′ increments a rejected box counter by one. Non-rejected boxes pass from belt section 52 (which remains in a horizontal "table-up" position) onto auxiliary belt 59 which routes them to storage or loading areas.

Referring now to the electrical schematic diagram of FIG. 8, the logic circuitry by which loose flaps are detected and the eject chute mechanism is actuated in response to such detection will be described.

Assuming supply line L2 to be at ground potential, a positive DC voltage signal is applied, via fuse 72 and wiring panel 74 from line L1 simultaneously to photocells B′, D′, E′, and F′ which are connected in parallel.

Interruption of light beam B—B′ in coincidence with interruption of either light beam A—A′ or C—C′ applies the L1 input voltage to the coil of relay 76, the other side of which is connected through a suitable resistance to ground line L2. Energization of this coil actuates the corresponding contact set which has the effect of applying the L1 input voltage to table-down solenoid 58*a* which (via pneumatic cylinder 56) pivots belt section 52 into its case reject position. As the rejected carton passes onto stationary down chute 62 it interrupts light beam F—F′ which supplies an actuation signal to relay 78. When the relay 78 contacts close the input voltage on line L1 is supplied to the table-up solenoid **58*b* to restore belt section 52** to its horizontal position.

In a similar manner, if either light beam D—D′ or E—E′ is interrupted the corresponding photocell will cause the input voltage on line L1 to be applied across relays 80 or 82, respectively, causing table-down solenoid 58a to pivot belt section 52 to its case eject position. Interruption of light beam F—F′ will then cause the table to be restored to a horizontal position.

Figure 8:
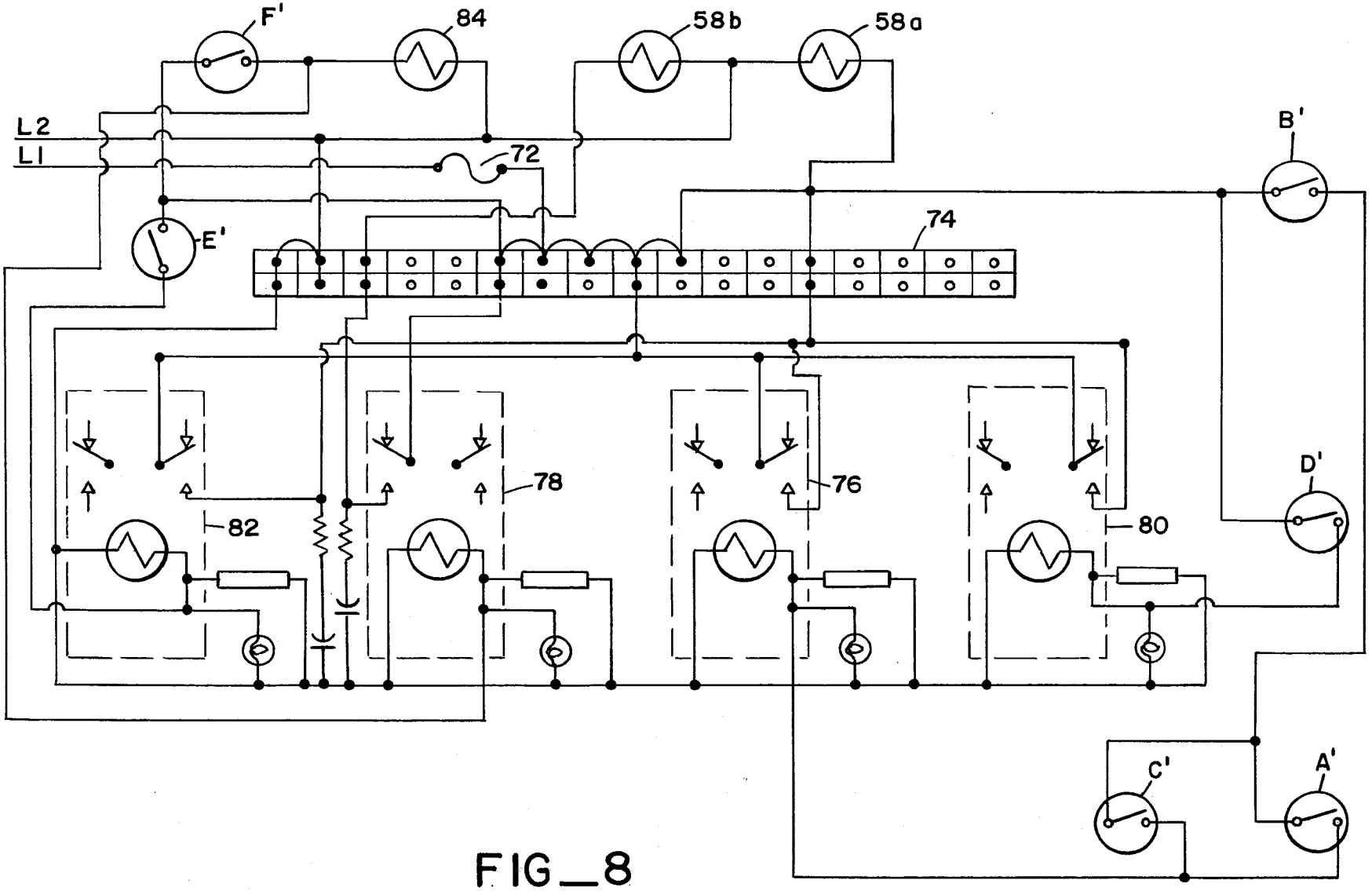
FIG. 8 is an electrical schematic diagram illustrating the logic circuitry for open flap detection and case eject chute activation.

It will be seen from FIG. 8 that each time photocell F′ records passage of a rejected carton a signal will be supplied to rejected box counter 84 which tallies the number of defective cartons.

While a preferred embodiment of the present invention has been shown and described above, it will be readily apparent to those skilled in the art that various modifications thereof can be made without departing from the spirit and scope of the invention as defined by the appended claims.

We claim:

1. In a packaging line of the type including transport means for moving a sequence of filled wrap-around paperboard cartons past a plurality of work stations to detect the presence of insecurely sealed closure flaps thereon, the improvement comprising:

impact means at a first of said work stations having at least one weighted roller pivotally suspended in the path of said cartons so as to allow said roller to arcuately strike the leading side wall of each of said cartons during movement by said transport means and thereafter to allow said roller to roll over the top surface of said moving cartons to open any insecurely sealed flap thereof;

optical open-flap detector means at a second of said work stations, said detector means including a plurality of spaced light source-photocell pairs in light beam alignment, positioned so that the light beam received by each of said photocells will be interrupted when a corresponding one of said closure flaps is in an open position; and diverter means for removing cartons having so-detected open flaps from said packaging line.

2. A method for detecting insecurely sealed closure flaps on paperboard cartons and for diverting cartons with defective flap seals from a packaging line comprising the steps of:

moving said cartons on a transport table past a plurality of work stations;

striking each of said cartons with an impact means as it passes a first work station to open any insecurely sealed flaps; and detecting at a second work station any cartons with closure flaps which have been so-opened by said impact means.

3. The method of claim 2 comprising the further step of diverting any of said cartons with so-detected open flaps from said packaging line.

* * * * *